US012584363B2

(12) United States Patent
Bryant et al.

(10) Patent No.: US 12,584,363 B2
(45) Date of Patent: Mar. 24, 2026

(54) ORIENTABLE WEIGHT BAR FOR A DOWNHOLE TOOL AND METHOD OF USING SAME

(71) Applicant: GR Energy Services Management, LP, Sugar Land, TX (US)

(72) Inventors: Cameron Michael Bryant, Sugar Land, TX (US); James William Anthony, Missouri City, TX (US); Jeremy Quentin Logan, Katy, TX (US)

(73) Assignee: GR Energy Services, Management, LP, Sugar Land, TX (US)

( * ) Notice: Subject to any disclaimer, the term of this patent is extended or adjusted under 35 U.S.C. 154(b) by 0 days.

(21) Appl. No.: 18/287,884

(22) PCT Filed: Apr. 22, 2022

(86) PCT No.: PCT/US2022/026055

§ 371 (c)(1),
(2) Date: Oct. 22, 2023

(87) PCT Pub. No.: WO2022/226379

PCT Pub. Date: Oct. 27, 2022

(65) Prior Publication Data

US 2024/0368953 A1 Nov. 7, 2024

Related U.S. Application Data

(60) Provisional application No. 63/178,451, filed on Apr. 22, 2021.

(51) Int. Cl.
*E21B 23/00* (2006.01)
*E21B 17/05* (2006.01)

(52) U.S. Cl.
CPC ..... *E21B 23/001* (2020.05); *E21B 17/05* (2013.01)

(58) Field of Classification Search
CPC ..... E21B 23/001; E21B 17/05
See application file for complete search history.

(56) References Cited

U.S. PATENT DOCUMENTS 2,409,811 A 10/1946 Taylor et al.
2,705,159 A 3/1955 Pfau
(Continued)

OTHER PUBLICATIONS

Applicant's Response to Saudi Arabia 2nd office action (redacted), dated Oct. 7, 2025, pp. 1-10.
(Continued)

*Primary Examiner* — Cathleen R Hutchins
(74) *Attorney, Agent, or Firm* — JL Salazar

(57) ABSTRACT

An orientable weight bar for a downhole tool includes a weight housing fixedly connectable to the downhole tool; an eccentric weight, and a weight lock. The eccentric weight is positioned in the weight housing. The eccentric weight has an offset mass along a radial portion thereof. The eccentric weight is rotationally and gravitationally movable within the weight housing to allow the offset mass to move to a weighted position within the weight housing. The weight lock is operatively connectable between the eccentric weight and the weight housing to secure the offset mass in the weighted position within the weight housing whereby, as the downhole tool advances through the wellbore, the eccentric weight gravitationally urges a portion of the downhole tool toward the bottom of the wellbore.

17 Claims, 5 Drawing Sheets

(56) References Cited

U.S. PATENT DOCUMENTS

| | | | | |
|---|---|---|---|---|
| 3,024,843 | A | 3/1962 | Vaughan | |
| 3,062,292 | A | 11/1962 | Lowrey et al. | |
| 3,211,222 | A | 10/1965 | Myers | |
| 3,713,393 | A | 1/1973 | O'Connor et al. | |
| 3,966,236 | A | 6/1976 | Vann | |
| 4,776,393 | A | 10/1988 | Forehand et al. | |
| 4,844,161 | A | 7/1989 | Rankin et al. | |
| 5,040,619 | A | 8/1991 | Jordan et al. | |
| 5,242,201 | A | 9/1993 | Beeman | |
| 5,484,029 | A | 1/1996 | Eddison | |
| 5,617,926 | A * | 4/1997 | Eddison | E21B 23/006 175/61 |
| 5,984,006 | A | 11/1999 | Read et al. | |
| 6,095,583 | A | 8/2000 | Beeman et al. | |
| 6,216,802 | B1 * | 4/2001 | Sawyer | E21B 7/067 175/73 |
| 6,431,269 | B1 | 8/2002 | Post et al. | |
| 6,450,541 | B1 | 9/2002 | Bakke | |
| 6,520,089 | B1 | 2/2003 | Avanci et al. | |
| 7,198,101 | B2 | 4/2007 | McGarian et al. | |
| 7,409,987 | B2 | 8/2008 | Fjelde | |
| 7,810,569 | B2 | 10/2010 | Hill et al. | |
| 8,267,012 | B2 | 9/2012 | Peeters et al. | |
| 8,960,093 | B2 | 2/2015 | Preiss et al. | |
| 9,581,422 | B2 | 2/2017 | Preiss et al. | |
| 9,605,937 | B2 | 3/2017 | Eitschberger et al. | |
| 9,810,035 | B1 | 11/2017 | Carr et al. | |
| 9,822,596 | B2 | 11/2017 | Clemens et al. | |
| 9,822,618 | B2 | 11/2017 | Eitschberger | |
| 9,903,185 | B2 | 2/2018 | Ursi et al. | |
| 9,915,513 | B1 | 3/2018 | Zemla et al. | |
| 10,036,236 | B1 | 7/2018 | Sullivan et al. | |
| 10,309,199 | B2 | 6/2019 | Eitschberger | |
| 10,365,079 | B2 | 7/2019 | Harrington et al. | |
| 10,507,433 | B2 | 12/2019 | Eitschberger et al. | |
| 10,626,689 | B2 | 4/2020 | Moyes | |
| 10,689,931 | B2 | 6/2020 | Mickey et al. | |
| 10,760,384 | B2 | 9/2020 | Schmidt et al. | |
| 10,794,122 | B2 | 10/2020 | Kitchen et al. | |
| 10,844,678 | B2 | 11/2020 | Mickey et al. | |
| 10,858,919 | B2 | 12/2020 | Anthony et al. | |
| 11,073,005 | B2 | 7/2021 | Schmidt et al. | |
| 11,078,763 | B2 | 8/2021 | Anthony et al. | |
| 12,123,273 | B1 | 10/2024 | Roach et al. | |
| 2003/0102162 | A1 | 6/2003 | Sloan et al. | |
| 2003/0188867 | A1 * | 10/2003 | Parrott | E21B 43/119 166/255.2 |
| 2004/0134667 | A1 | 7/2004 | Brewer et al. | |
| 2005/0067169 | A1 | 3/2005 | Wills | |
| 2006/0048940 | A1 | 3/2006 | Hromas et al. | |
| 2006/0070739 | A1 | 4/2006 | Brooks et al. | |
| 2012/0247769 | A1 | 10/2012 | Schacherer et al. | |
| 2013/0008669 | A1 | 1/2013 | Deere et al. | |
| 2014/0033939 | A1 | 2/2014 | Priess et al. | |
| 2015/0247368 | A1 | 9/2015 | Clemens et al. | |
| 2015/0345922 | A1 | 12/2015 | Lanclos et al. | |
| 2016/0047199 | A1 | 2/2016 | Hardesty et al. | |
| 2016/0061572 | A1 | 3/2016 | Eitschberger et al. | |
| 2016/0115753 | A1 | 4/2016 | Frazier et al. | |
| 2016/0356132 | A1 | 12/2016 | Burmeister et al. | |
| 2017/0030693 | A1 | 2/2017 | Preiss et al. | |
| 2017/0074078 | A1 | 3/2017 | Eitschberger | |
| 2018/0038208 | A1 | 2/2018 | Eitschberger | |
| 2018/0080298 | A1 | 3/2018 | Covalt et al. | |
| 2018/0224260 | A1 | 8/2018 | Zemla et al. | |
| 2018/0258724 | A1 | 9/2018 | Massey et al. | |
| 2018/0299239 | A1 | 10/2018 | Eitschberger et al. | |
| 2019/0016969 | A1 | 1/2019 | Kandel et al. | |
| 2019/0086189 | A1 | 3/2019 | Eitschberger et al. | |
| 2019/0106969 | A1 | 4/2019 | Sullivan et al. | |
| 2019/0127290 | A1 | 5/2019 | Löhken et al. | |
| 2019/0178045 | A1 | 6/2019 | Frazier et al. | |
| 2019/0234189 | A1 | 8/2019 | Preiss | |
| 2019/0242209 | A1 | 8/2019 | Anthony et al. | |
| 2019/0242222 | A1 | 8/2019 | Eitschberger | |
| 2019/0277103 | A1 | 9/2019 | Wells et al. | |
| 2019/0330947 | A1 | 10/2019 | Mulhern et al. | |
| 2019/0376775 | A1 | 12/2019 | Preiss et al. | |
| 2020/0024920 | A1 * | 1/2020 | Varkey | E21B 17/1014 |
| 2020/0024935 | A1 | 1/2020 | Eitschberger et al. | |
| 2020/0032601 | A1 | 1/2020 | Nguyen et al. | |
| 2020/0048996 | A1 | 2/2020 | Anthony et al. | |
| 2020/0063537 | A1 | 2/2020 | Langford et al. | |
| 2020/0072029 | A1 | 3/2020 | Anthony et al. | |
| 2020/0182025 | A1 | 6/2020 | Brady | |
| 2020/0256166 | A1 | 8/2020 | Knight et al. | |
| 2020/0277837 | A1 | 9/2020 | Hern et al. | |
| 2020/0362652 | A1 | 11/2020 | Eitschberger et al. | |
| 2021/0040805 | A1 | 2/2021 | Kehoe et al. | |
| 2021/0047903 | A1 | 2/2021 | Albert | |
| 2021/0123311 | A1 | 4/2021 | Rosenthal | |
| 2022/0145732 | A1 | 5/2022 | Anthony et al. | |
| 2024/0035347 | A1 | 2/2024 | Zakharia et al. | |
| 2024/0254846 | A1 | 8/2024 | Bryant et al. | |
| 2024/0254847 | A1 | 8/2024 | Bryant et al. | |
| 2024/0254848 | A1 | 8/2024 | Bryant et al. | |
| 2024/0254849 | A1 | 8/2024 | Bryant et al. | |

OTHER PUBLICATIONS

Applicant's Response to Saudia Arabia 1st Office Action (with translation), dated Feb. 23, 2025, pp. 1-9.

GR Energy Services, ZipSet Setting Tool, GR-PUB031-20180103, dated Jan. 3, 2018, p. 1.

PCT International Search Report & Written Opinion, Jul. 22, 2022, pp. 1-13.

Saudi Arabia 2nd office action (with translation), dated Jul. 27, 2025, pp. 1-13.

Saudia Arabia 1st Office Action (with translation), dated Dec. 12, 2024, pp. 1-17.

* cited by examiner

ORIENTABLE WEIGHT BAR FOR A DOWNHOLE TOOL AND METHOD OF USING SAME

CROSS-REFERENCE TO RELATED APPLICATIONS

This application claims the benefit of U.S. Provisional Application No. 63/178,451 entitled "Orientable Weight Bar for a Downhole Tool and Method of Using Same" and filed on Apr. 22, 2021, the entire contents of which is hereby incorporated by reference herein to the extent not inconsistent with the present disclosure.

BACKGROUND

The present disclosure relates generally to oilfield technology. More specifically, the present disclosure relates to techniques for manipulating (e.g., orienting) downhole tools.

Wellsite operations are performed to locate and access subsurface targets, such as valuable hydrocarbons. Drilling equipment is positioned at the surface and downhole drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

During the wellsite operations, various downhole tools, may be deployed into the earth to perform various procedures, such as measurement, perforation, injection, plugging, etc. Examples of downhole tools are provided in US Patent/Application Ser. Nos. 10200024935; 10507433; 20050067169; 20200277837; 20170576775; 20170530947; 20190242222; 20190234189; 10309199; 20190127290; 20190086189; 20190242209; 20180299239; 20180224260; 9915513; 20180038208; 9822618; 9605937; 20170074078; 9581422; 20170030693; 20160556132; 20160061572; 8960093; 20140033939; 8267012; 6520089; 20160115753; 20190178045; 10365079; 10844678; 10365079; 10036236; 10365079; 3713393; 3024843; 20200072029; 20200048996; 20150345922; and 20160115753 the entire contents of which is hereby incorporated by reference herein to the extent not inconsistent with the present disclosure.

Despite advancements in downhole technology, there remains a need for manipulating (e.g., orienting) downhole tools positioned in compact downhole environments and to facilitate movement of the downhole tool through the wellbore. The present disclosure is directed at providing such needs.

SUMMARY

In at least one aspect, the disclosure relates to an orientable weight bar for a downhole tool, comprising: a weight housing fixedly connectable to the downhole tool; an eccentric weight; and a weight lock. The eccentric weight is positioned in the weight housing. The eccentric weight has an offset mass along a radial portion thereof. The eccentric weight is rotationally and gravitationally movable within the weight housing to allow the offset mass to move to a weighted position within the weight housing. The weight lock is operatively connectable between the eccentric weight and the weight housing to secure the offset mass in the weighted position within the weight housing whereby, as the downhole tool advances through the wellbore, the eccentric weight gravitationally urges a portion of the downhole tool toward the bottom of the wellbore.

In another aspect the disclosure relates to a downhole tool, comprising: at least one downhole component; and an orientable weight bar operatively connectable to the at least one downhole component. The orientable weight bar comprises: a weight housing fixedly connectable to the downhole tool; an eccentric weight; and a weight lock. The eccentric weight is positioned in the weight housing. The eccentric weight has an offset mass along a radial portion thereof. The eccentric weight is rotationally and gravitationally movable within the weight housing to allow the offset mass to move to a weighted position within the weight housing. The weight lock is operatively connectable between the eccentric weight and the weight housing to secure the offset mass in the weighted position within the weight housing whereby, as the downhole tool advances through the wellbore, the eccentric weight gravitationally urges a portion of the downhole tool toward the bottom of the wellbore.

Finally, the disclosure relates to a method of orienting a downhole tool, comprising: connecting an orientable weight bar to the downhole tool (the orientable weight bar comprising a weight housing and an eccentric weight); manipulating the downhole tool with the orientable weight bar by: positioning in the eccentric weight in a weighted position within the weight housing by allowing the eccentric weight to gravitationally move within the weight housing; locking the eccentric weight in the weighted position; and the advancing the downhole tool through the wellbore with the eccentric weight in the weighted position.

In at least one aspect, the disclosure relates to an orientable weight bar for a downhole tool. The orientable weight bar comprises a weight housing; weights; and a weight link assembly. The weights may comprise internal and/or external weights. The weight link comprises an uphole connector and a downhole connector with a cable therebetween.

In another aspect, the disclosure relates to a downhole tool. The downhole tool comprises at least one downhole component; and the orientable weight bar. The downhole component comprises at least one of a collar locator, a perforating gun, a setting tool, and a plug assembly.

In another aspect, the disclosure relates to a method of orienting a downhole tool. The method comprises connecting an orientable weight bar to a downhole tool; positioning the downhole tool in a wellbore; and manipulating the downhole tool with the orientable weight bar.

Finally, the disclosure also relates to the orientable weight bar, downhole tool, and methods as described herein.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

Figure 1:
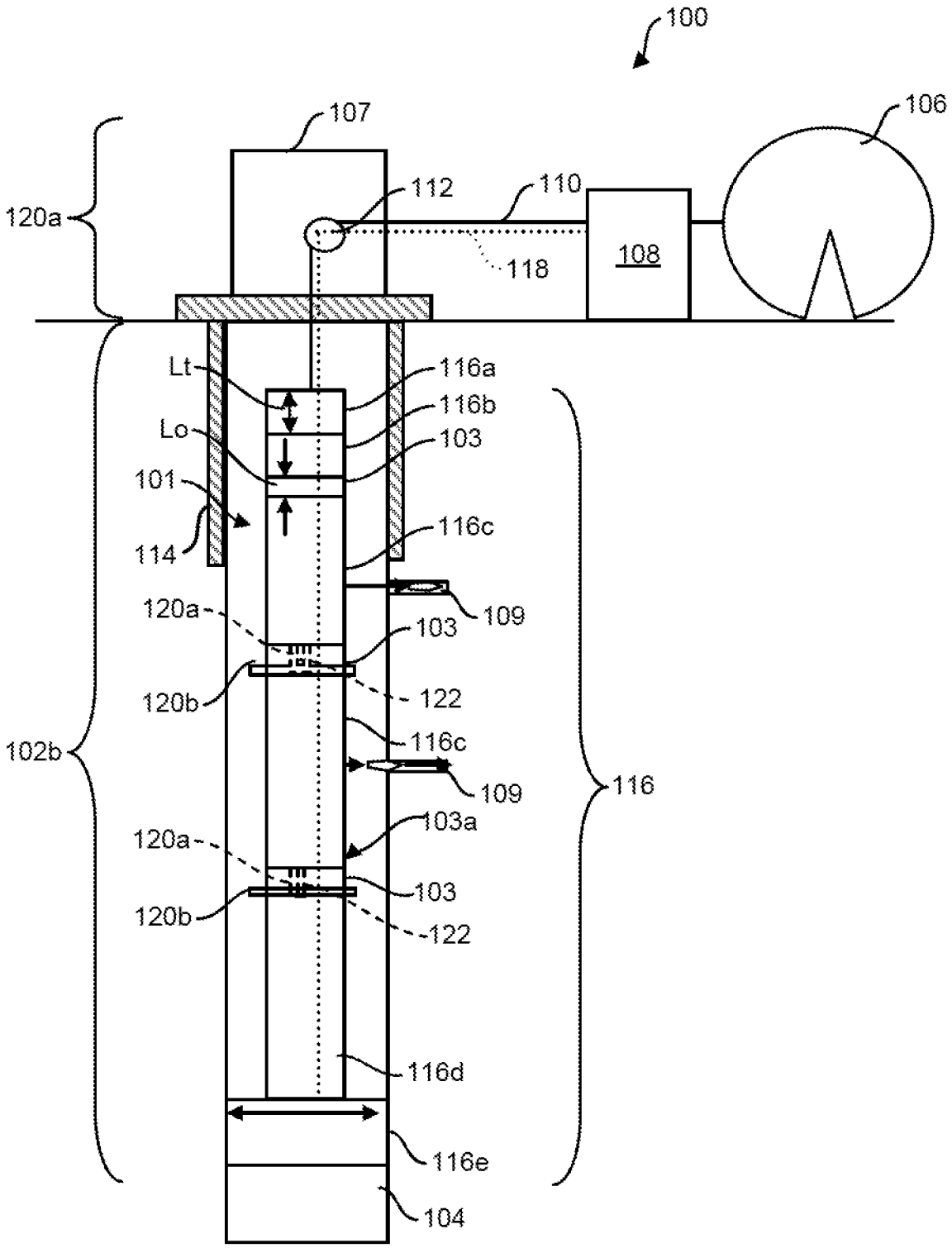
FIG. 1 is a schematic view of a wellsite with surface and downhole equipment, the downhole equipment comprising a downhole tool including an orientable weight assembly with orientable weight bars.

The description that follows includes exemplary apparatus, methods, techniques, and/or instruction sequences that embody techniques of the present subject matter. However, it is understood that the described embodiments may be practiced without these specific details.

This disclosure relates to an orientable weight assembly for manipulating a downhole tool positioned in a wellbore at a wellsite. The orientable weight assembly may be in the form of an orientable weight bar for facilitating the movement of a downhole tool through the wellbore. The orientable weight bar may include a weight housing with internal weights with an offset mass positionable about the weight housing. The weights may be positioned about the weight housing for manipulating a position of the downhole tool. By allowing the weights inside the weight housing to gravitationally fall to a weighted position and then locking the weights in place, a bottom the downhole tool along the weight position remains along a bottom of the wellbore as the downhole tool passes through the wellbore. The orientable weight bar may also include a weight link for passing electrical signals therethrough.

One or more of the orientable weight bars may be positioned about various portions of the downhole tool adjacent to various downhole components. The orientable weight bars may be positioned adjacent certain downhole components, such as perforating tools (guns), for manipulating (e.g., orientating) the perforating tools as the downhole tool moves through the wellbore. The configuration of the interior and exterior weights may enable the orientation to occur at a select time, thereby 'timing' the manipulation of the downhole components and/or the downhole tool.

One or more orientable weight bar may be used with one or more downhole components in the downhole tool. The combination of multiple downhole components formed into one assembly (e.g., a tool string) is referred to as a 'downhole tool.' The downhole tool may be a modular assembly including various combinations of multiple downhole components, such as a cable release, the weight bars, a collar locator, a perforating tool (gun), a release tool, a setting tool, a plugging tool, an electronics hub, etc. One or more downhole components may be included in a single housing, or in separate housings of the downhole tool. The downhole components may be operatively (e.g., electrically and/or mechanically) connected together. One or more of the downhole components may operate separately or in concert.

The present disclosure seeks to provide one or more of the following, among others: reliability, operability in harsh downhole conditions, ease of manufacture and assembly, compact size positionable in various locations, ability to couple to or integrate with existing components, operability with components of other tools for use therewith, reduction in cost, increased efficiency, elimination of redundant components, timed operation, ability to maintain orientation of downhole components, adjustable configurations, flexibility of use, ability to change configurations to match operational needs, ability to provide one or more configurations, ability to maintain position for increased accuracy, time savings, efficient operation, low maintenance costs, compact design, replaceable and/or disposable components, etc.

FIG. 1 is a schematic view of a wellsite 100 with surface equipment 102*a* and downhole equipment 102*b*, the downhole equipment 102*b* comprising a downhole tool 101 including the orientable weight assembly 103*a* with orientable weight bars 103. The surface equipment 102*a* and the downhole equipment 102*b* are positioned about a wellbore 104 at the wellsite 100. The wellsite 100 may be any wellsite positioned about a subterranean formation, such as an unconventional formation (e.g., shale) with a reservoir (e.g., oil, gas, water, etc.) therein.

The surface equipment 102*a* includes a conveyance reel 106, and a surface unit 108. The surface equipment 102*a* may include a wellhead 107 (and other surface components) positioned about the top of the wellbore 104. The conveyance reel 106 may be a spool rotationally mounted at the surface. The wireline reel 106 supports a conveyance 110 as it is deployed into the wellbore 104. A pulley 112 may optionally be provided to support the conveyance 110 about the wellbore 104 as schematically shown. In the example of FIG. 1, the conveyance 110 is a wireline cable electrically and communicatively coupled between the surface unit 108 and the downhole tool 101 for passing signals therebetween.

The downhole equipment 102*b* comprises the downhole tool 101 positioned in the wellbore 104 and supported therein by the conveyance 110. The wellbore 104 may have a casing 114 therein to line a surface of the wellbore 104. The downhole tool 101 may be deployed through the casing and into an open portion of the wellbore 104 via the conveyance 110 for performing downhole operations. The downhole tool 101 is provided with various downhole components 116 for performing such downhole operations.

FIG. 1 shows an example configuration of the downhole tool 101. In this example, the downhole tool 101 includes several downhole components 116 connected together to form a tool string. The downhole components 116 in this example include an over the line weight bar 116*a*, a collar locator 116*b*, the orientable weight bar 103, perforating tools 116*c*, a setting tool 116*d*, and a plugging tool 116*e*. Various arrangements of one or more of the downhole components 116*a-e* (and/or other downhole components 116, such as a release tool, electronics sub, etc. (not shown)) may be provided.

The downhole components 116 as shown are used to perform various downhole operations, such as perforating. The over the line weight bar 116*a* may operatively connect the downhole tool 101 to the conveyance 110. The over the line weight bar 116*a* may be weighted cylinders shaped to support the downhole tool 101. In this example, the over the line weight bar 116*a* is provided without electronics. The collar locator 116*b* may be used to locate portions of the casing 114, or other items along the wellbore 104. As schematically shown, the perforating tools (guns) 116*c* may be used to launch shaped charges to form perforations 109 along the wall of the wellbore 104. Examples of perforating tools are provided in US Patent/Application Nos. 10,036,236; 20200072029; and 20200048996, previously incorporated herein.

The setting tool 116*d* may be used to activate downhole components 116 in the downhole tool 101. In the example shown, the setting tool 116*d* is coupled to the plugging tool 116*e*. The setting tool 116*d* may be activated from the surface to deploy the plugging tool 116*e* (as indicated by the double arrow) to anchor the downhole tool 101 along the wellbore 104. Examples of techniques for setting and plugging are described in U.S. patent application No. 20190242209; 103a65079; 10844678; and 3,024,843, previously incorporated by reference herein.

The orientable weight assembly 103*a* may include one or more orientable weight bars 103 and/or one or more associated downhole component(s) 116*a-e*. The orientable weight bars 103 may be positioned in various locations about the downhole tool 101 for manipulating one or more of the downhole components 116*a-e*. In the example shown, three of the orientable weight bars 103 are provided. Each of the orientable weight bars 103 is positioned uphole from a corresponding one of the perforating tools 116*c* and the setting tool 116*d*. Each of the orientable weight bars 103 may have internal (eccentric) weights 120*a* for manipulating (e.g., orienting) the respective, adjacent downhole components 116*c,d* and/or the downhole tool 101 as is described further herein. The orientable weight bars 103 may also be provided with standoff rings 120*b* about an external surface thereof.

The downhole tool 101 may be communicatively coupled by a communication link 118 to the surface to receive signals therefrom. In the example shown in FIG. 1, the communication link 118 extends from the surface unit 108 and to the downhole tool 101 via the conveyance 110. The surface unit 108 may be provided with personnel (e.g., operators) and/or electronics (e.g., central processing units (CPUs), controllers, etc.) for sending and/or receiving signals via the communication link 118 to the downhole tool 101.

The communication link 118 may extend in series through each of the downhole components 116*a-e* and the orientable weight bars 103. Each of the downhole components 116*a-e* may be capable of receiving signals from the surface via the communication link 118. These signals may be used to activate (e.g., trigger) one or more of the downhole components 116*a-e* to perform downhole operations, such as perforating and setting.

Each of the downhole components 116*a-e* may be communicatively coupled to other downhole components 116*a-e* and/or the orientable weight bars 103 for passing signals therethrough. This coupling may be used to extend the communication link 118 through each of the downhole components 116*a-e* and the orientable weight bars 103. The orientable weight bars 103 may be provided with an electronics connection assembly 122 positionable about orientable weight bars 103 for passing signals from a downhole component 116 uphole of the orientable weight bars 103 to another downhole component 116 downhole from the orientable weight bars 103 as is described further herein.

While FIG. 1 shows a certain configuration of the wellsite 100, the surface equipment 102*a*, and the downhole equipment 102*b*, various configurations may be used. For example, one or more communication links 118, surface units 108, and/or other devices may be provided for use with the downhole tool 101 and the orientable weight bars 103. In another example, the downhole tool 101 may have one or more orientable weight bars 103 in use with one or more of the downhole components 116. Various configurations of the over the line weight bar 116*a* and/or the orientable weight bar 103 may be used.

Figure 2:
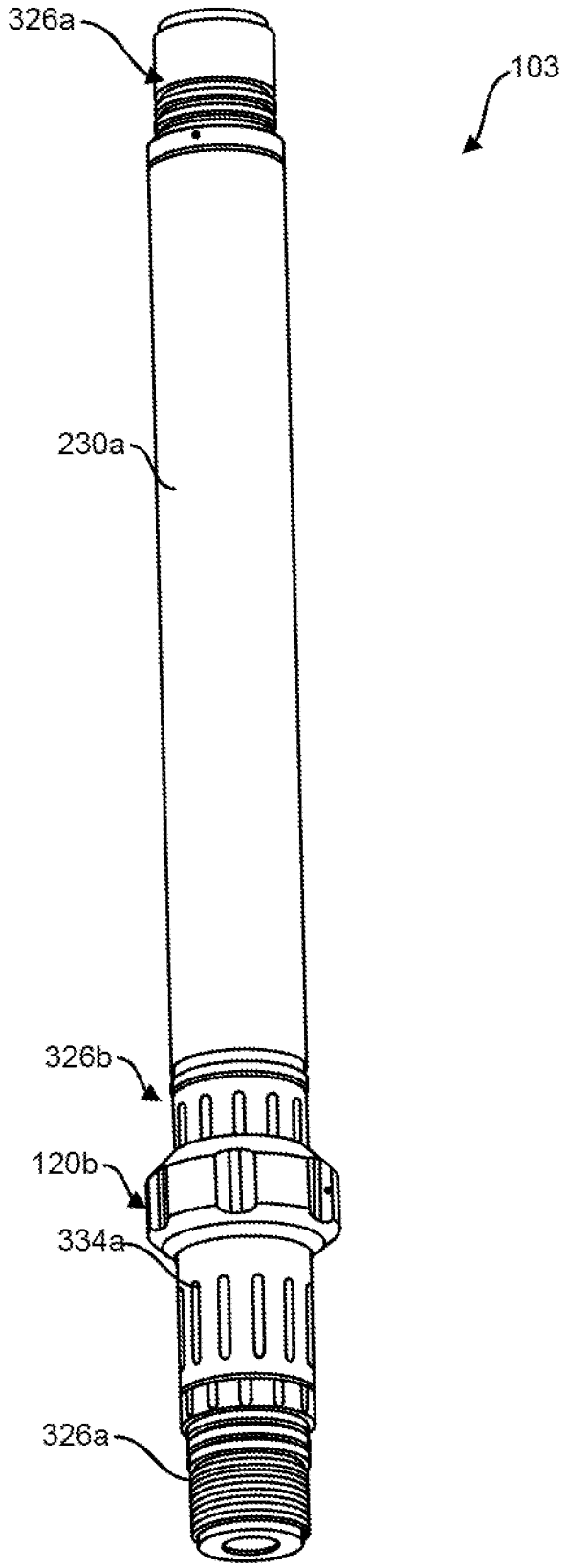
FIG. 2 is a perspective view of the orientable weight bar.
Figure 3:
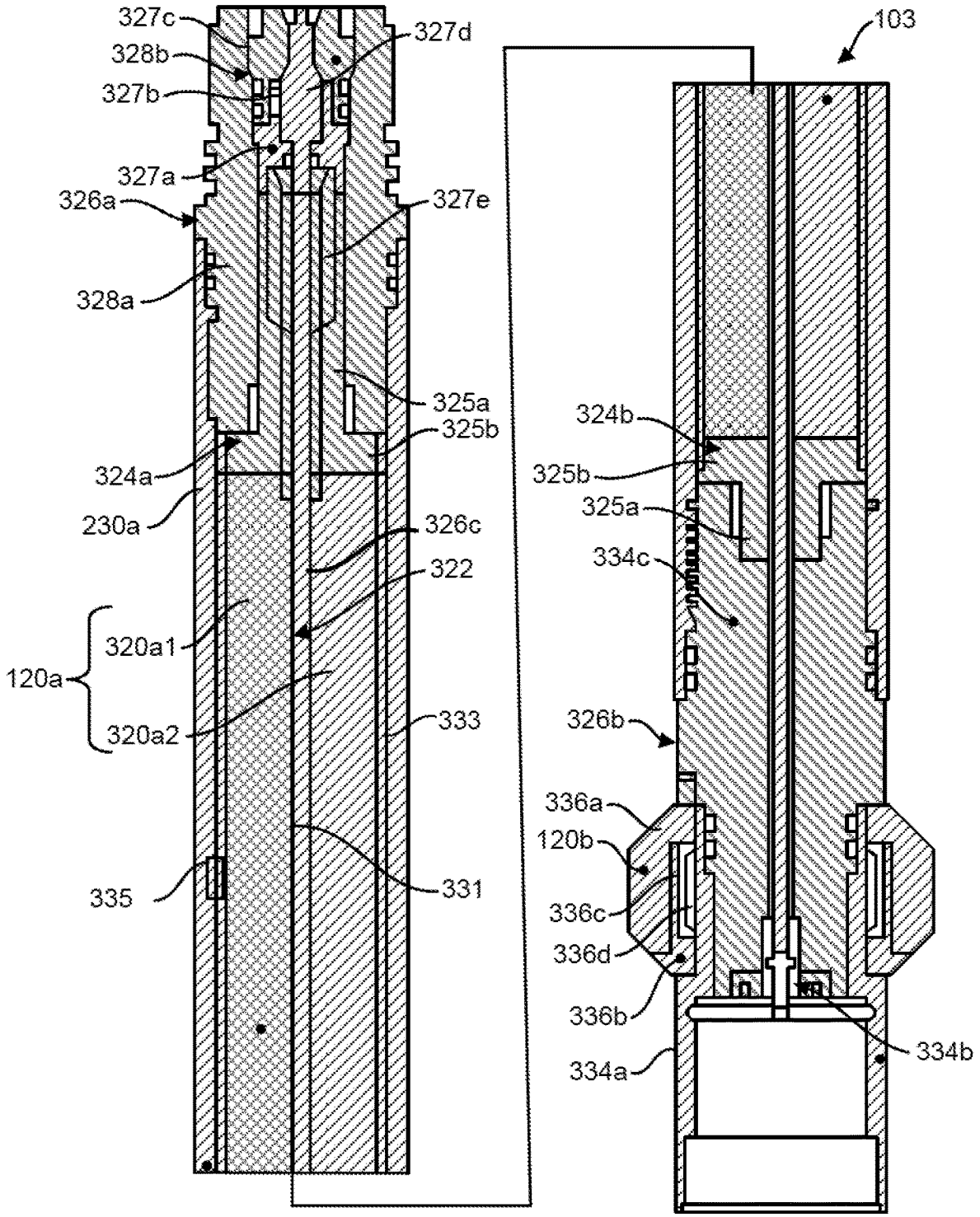
FIG. 3 is a cross-sectional view of the orientable weight bar.
Figure 4:
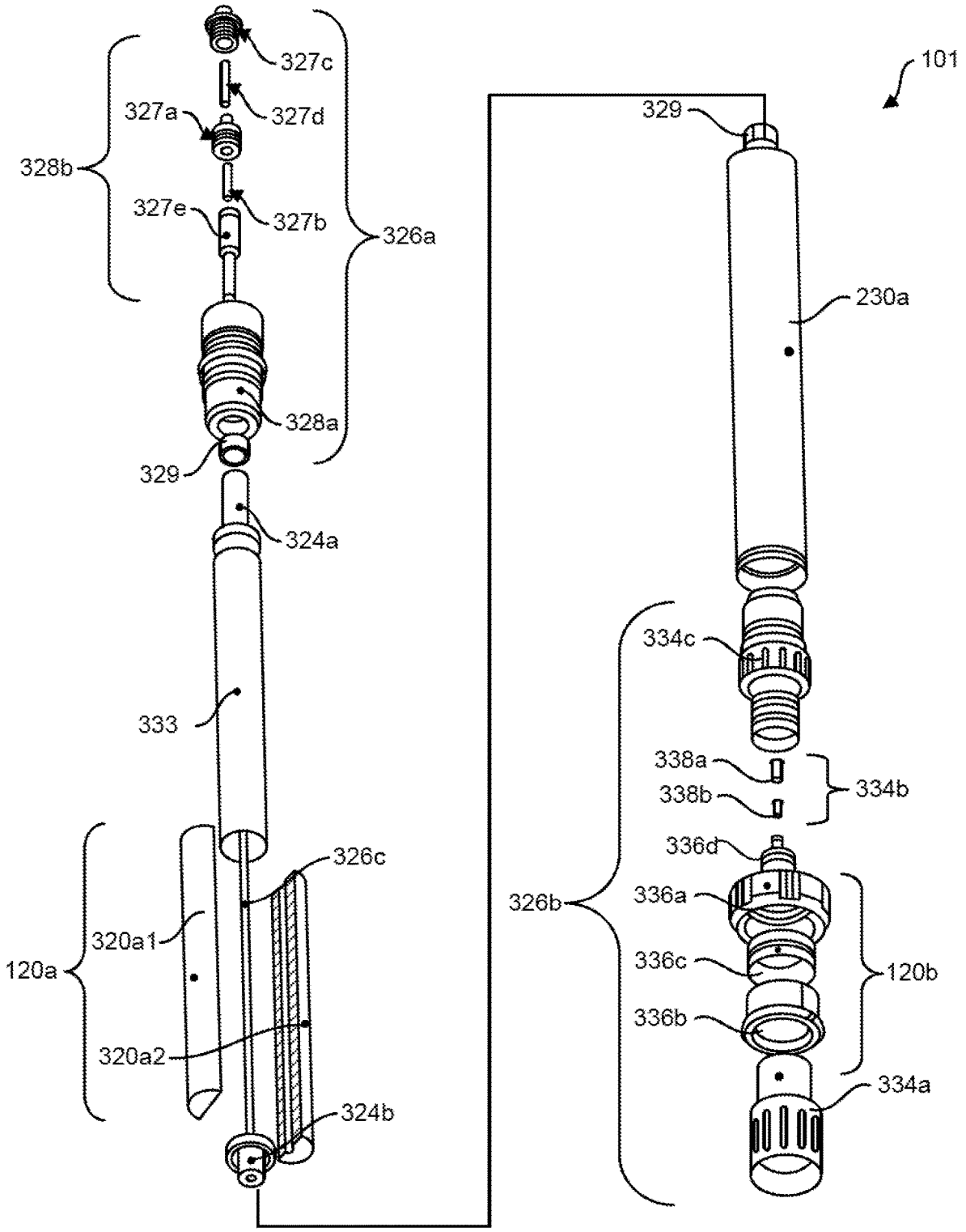
FIG. 4 is an exploded view of the downhole tool with the orientable bars.
Figure 5:
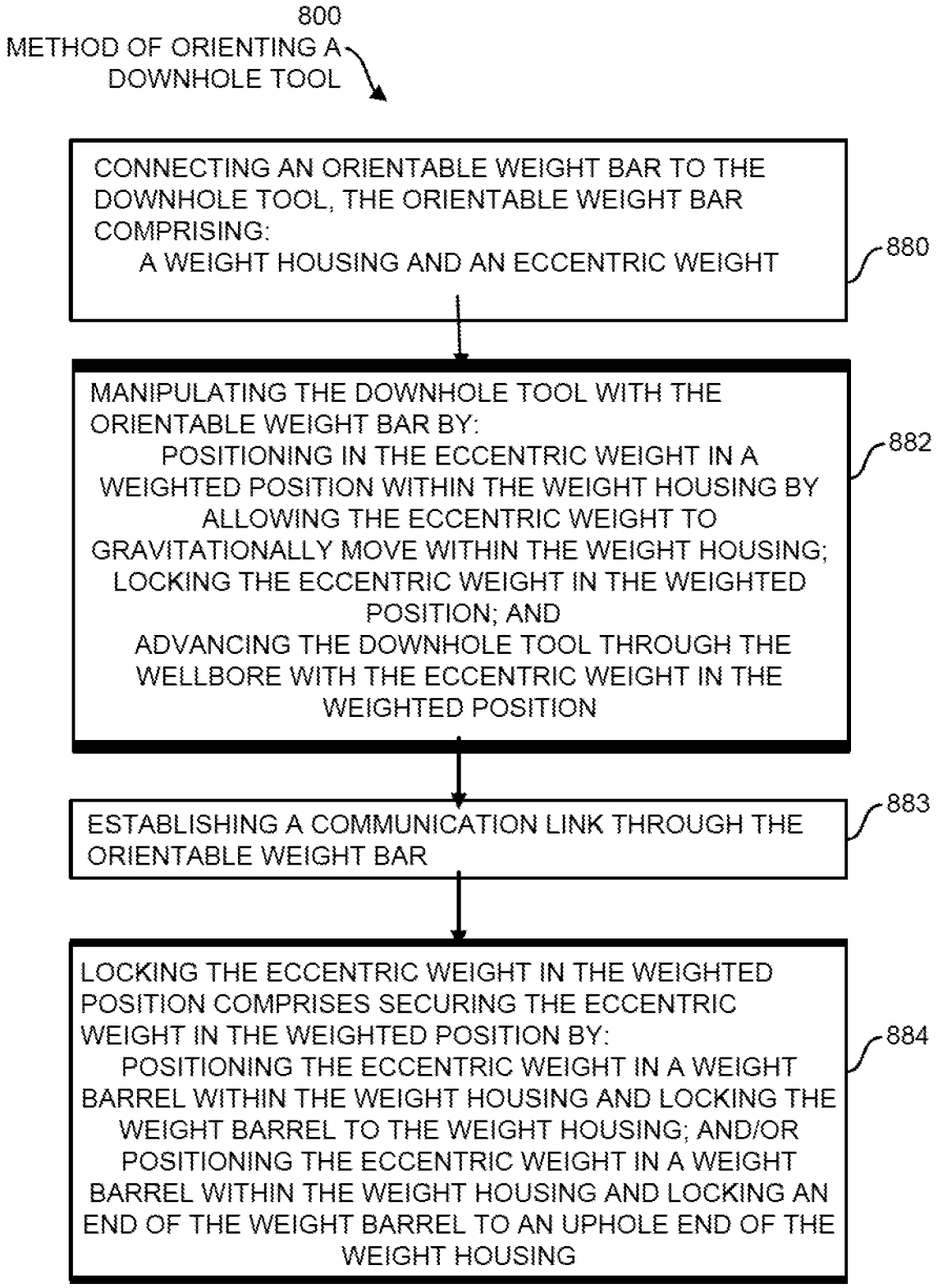
FIG. 5 is a flow chart depicting a method of orienting a downhole tool.

FIGS. 2-4 show an example configuration of the orientable weight bar 103. FIG. 2 is a perspective view of the orientable weight bar 103. FIG. 3 is a cross-sectional view of the orientable weight bar 103. FIG. 4 is an exploded view of the downhole tool 101 with the orientable weight bars 103. As shown in these figures, the orientable weight bar 103 includes a weight housing 230*a*, the internal weights 120*a*, the standoff rings 120*b*, and a weight link 322.

The weight housing 230*a* is a tubular member shaped for connection to adjacent downhole components 116 (FIG. 1). The weight housing 230*a* may be shaped to receive components for storage therein, such as the internal weights 120*a* and portions of the weight link 322 (and/or the communication link 118 of FIG. 1). The weight housing 230*a* may have one or more portions threaded together. The weight housing 230*a* may also be threaded to one or more subs or connectors for connection to the downhole components 116.

The internal weights 120*a* may include one or more solid members shaped for insertion into the weight housing 230*a*. The internal weights 120*a* may be made of various materials. For example, the internal weights 120*a* may include a synthetic internal weight 320*a*1 made of a synthetic material, such as Teflon® (polytetrafluoroethylene), and a metal weight 320*a*2 made of a metal, such as tungsten or lead. Various internal weights 120*a* with the same or different materials and/or having various shapes may be used.

In the example of FIG. 2, the internal weights 120*a* include two elongate members positioned within the weight housing 230*a*. The internal weights 120*a* may be shaped for receipt into the weight housing 230*a*, and/or to accommodate components within the weight housing 230*a*. In the example shown, each of the internal weights 120*a* are arcuate, hemispheric-shaped portions that, when positioned together, form a cylindrical shape receivable in the weight housing 230*a*. The internal weights 120*a* may be configured with an eccentric mass such that a heavier portion of the internal weights is located about a radial portion thereof. When positioned together, a channel is defined through the internal weights 120*a*. The channel extends through the internal weights 120*a* and defines a portion of a link passage 331 extending through the orientable weight bar 103.

A weight bar barrel 333 may be concentrically positioned between the weight housing 230*a* and the internal weights 120*a* to provide additional support. The weight bar barrel 333 may be a tubular member receivably positioned in the weight housing 230*a* and conforming to an internal surface therein. A key 335 may be positioned between the weight bar barrel 333 and the weight housing 230*a*. The key 335 may be, for example, a finger extendable from the weight bar barrel 333 and into a corresponding keyway in the weight housing 230*a* to prevent movement of the weight bar barrel 333 and/or to lock the weight bar barrel 333 in place within the weight housing 230*a*. The weight barrel 333 may be shaped to receive the internal weights 120*a* therein.

The internal weights 120*a* are supported in the weight housing 230*a* by uphole and downhole end caps 324*a,b*. The end caps 324*a,b* are positioned about each end of the internal weights 120*a* to provide support thereto. The end caps 324*a,b* positioned in each end of the weight bar barrel 333 to seal the internal weights 120*a* therein. The end caps 324*a,b* may have a tubular neck 325*a* and a flanged end 325*b*. Each of the flanged ends 325*b* has a flat surface positionable against an end of the internal weights 120*a*. The end caps 324*a,b* are also provided with holes therethrough to continue the link passage 331 therethrough.

The weight link 322 includes an uphole sub 326*a*, a downhole sub 326*b*, and a link cable 326*c*. As shown in FIG. 2, the downhole sub 326*b* may be connectable to the uphole sub 326*a* of an adjacent orientable weight bar 103. The link cable 326*c* may be a wire or collection of wires that electrically couple the downhole sub 326*b* to the uphole sub

326*a*. The link cable 326*c* may extend through the link passage 331 to each of the uphole and downhole subs 326*a,b*. The weight link 322 may form a portion of or be connected to the communication link 118 (FIG. 1) for communication with the surface or other of the downhole components 116.

The uphole sub 326*a* includes an uphole connector 328*a* and a locking assembly 328*b*. The uphole connector 328*a* is a tubular member with threads along an outer surface thereof. The uphole connector 328*a* has a downhole end insertable into and threadably connectable to an uphole end of the weight housing 230*a*, and an uphole end threadedly connectable to an adjacent downhole component 116 (FIG. 1). The uphole connector 328*a* has a portion of the link passage 331 therethrough shaped to receive the tubular neck 325*a* of the end cap 324*a* therein. An internal bearing 329 may be positioned between the tubular neck 325*a* and the uphole connector 328*a*. The internal bearings 329 may be needle (roller), ball or other bearings. The end caps 324*a,b* may support the internal weights 320*a*1,*b*2 in an eccentric position seated within the roller bearings 329.

The locking assembly 328*b* is positioned in the uphole end of the threaded connector 328*a*. The locking assembly 328*b* includes a lock nut 327*a*, a spring 327*b*, a bulkhead 327*c*, an uphole feedthru 327*d*, and an insulator 327*e*. The locking assembly 328*b* may be used to allow movement of the orientable weight bar 103 within the downhole tool 101 so that the downhole tool 101 naturally falls to a resting position heavy side down due to the eccentricity of the weight. The lock assembly 328*b* is movable between a locked and unlocked position to selectively allow movement of the internal weights 320*a*1,*a*2.

The lock nut 327*a* is positioned within the uphole connector 328*a* between the uphole end cap 324*a* and the bulkhead 327*c*. The bulkhead 327*c* may be a hex retainer positioned at an uphole end of the uphole connector 328*a*. The bulkhead 327*c* may shaped to receivingly support the uphole feedthru 327*d* for electrical coupling with the adjacent downhole component 116.

The uphole feedthru 327*d* may be positioned within the bulkhead 327*c* about the uphole end of the uphole connector 328*a*. An uphole end of the uphole feedthru 327*d* may be mated with a corresponding electrical connector in the adjacent downhole component 116. A downhole end of the uphole feedthru 327*d* may be electrically coupled to the link cable 326*c* for passing signals from the adjacent downhole component 116 and to the link cable 326*c*.

The spring 327*b* may be a wave spring positioned between the feedthru 327*d* and the bulkhead 327*c*. The spring 327*b* may be used to selectively disconnect the orientable weight bar 103 from frictional surfaces when the bulkhead 327*c* is loosened on the opposite side. Washers (e.g., NORD-LOCK™ washers commercially available from Nord-Lock Group at 1200 Clifford Ball Drive, Clinton, PA 15026) (not shown) may be positioned about the bulkhead 327*c* to lock the internal weights 320*a*1,*a*2 in place once the bulkhead 327*c* is tightened.

The insulator 327*e* may be positioned in the portion of the link passage 331 extending into the end cap 324*a* and the lock nut 327*a*. The insulator 327*e* may be a tubular member extending from within the end cap 324*a* to within the lock nut 327*a*. The insulator 327*e* may be made of a non-conductive material shaped to electrically isolate the locking nut 327*a* and the end cap 324*a* from the link cable 326*c* extending therethrough.

The downhole sub 326*b* includes a downhole connector (pin sub) 334*c*, a box sub 334*a*, and a downhole coupler 334*b*. The downhole connector 334*c* is a tubular member with threads along an outer surface thereof. The downhole connector 334*c* has an uphole end insertable into and threadably connectable to a downhole end of the weight housing 230*a*, and a downhole end threadedly connectable to the box sub 334*a*. The downhole connector 334*c* has a portion of the link passage 331 therethrough shaped to receive the tubular neck 325*a* of the downhole end cap 324*b*. While not shown, another needle bearing 329 may be positioned between the tubular neck 325*a* and the downhole connector 334*c*.

The box sub 334*a* is a tubular member connected between the downhole connector 334*c* and an adjacent downhole component 116 (FIG. 1). The box sub 334*a* has a stepped outer surface shaped to receive the standoff ring 120*b* thereabout. The standoff ring 120*b* is a ring-shaped member positioned about the box sub 334*a* adjacent to the downhole connector 334*c*. The standoff ring 120*b* includes a female roller standoff 336*a*, a male roller standoff 336*b*, a roller bearing 336*c*, and a sleeve 336*d*. The female roller standoff 336*a* is concentrically positioned about the box sub 334*a*. The roller bearing 336*c* is concentrically positioned within the female roller standoff 336*a*, and the male roller standoff 336*b* is concentrically positioned between the roller bearing 336*c* and the box sub 334*a*. The link passage 331 extends through the downhole connector 334*c* and the box sub 334*a*.

The downhole coupler 334*b* is positioned at a downhole end of the downhole connector 334*c* and at a downhole end of the link cable 326*c*. The downhole connector 334*c* may include an insulator sleeve 338*a* and a downhole feedthru 338*b*. The insulator sleeve 338*a* may be a tubular, non-conductive material positioned in a downhole end of the downhole connector 334*c*. The downhole end of the link cable 326*c* may extend through the downhole coupler and into the insulative sleeve 338*a* for electrical coupling with the feedthru 338*b*. The link cable 326*c* is coupled with the uphole feedthru 327*d* and the downhole feedthru 338*b* to form a link assembly. The feedthru 338*b* also extends into the insulative sleeve 338*a* for electrical isolation from the downhole connector 334*c*. The downhole feedthru 338*b* may be electrically coupled to the link cable 326*c* at one end and to the adjacent downhole component 116 at another end for passing signals between the link cable 326*c* and the adjacent downhole component 116.

While FIGS. 2-4 show a specific configuration of the orientable weight bar 103, it will be appreciated that variations may be included. For example, while the specific configuration refers to uphole and downhole positions, such positions may be reversed. In another example, while the orientable weight bar 103 is shown with two internal weights 320*a*1,*b*1 and a single standoff ring 120*b* in certain positions along the orientable weight bar 103, it will be appreciated that one or more of various configurations of weights may be located in various positions about the orientable weight bar 103.

Referring back to FIG. 1, the orientable weight bars 103 may be used to manipulate the perforating tools 116*c* to provide an oriented gun carrier system. The orientable weight bars 103 may have a compact configuration that is shorter than traditional weight bars. For example, the axial length Lo of the orientable weight bar may be less than half of axial length Lt of the traditional over the line weight bar 116*a*. This shorter configuration may be used to facilitate installation (e.g., rig up) between perforating tools 116*c*.

Traditionally, over the line weight bars 116*a* are made up at an uphole end of the downhole tool 101 with the perforating tools 116*c* and the plugging tool 116*e* being located at or near a downhole end of the downhole tool 101 with the weight focused at an uphole end of the downhole tool 101. The orientable weight bars 103 may be distributed about the perforating tools 116*c* to distribute the weight throughout the downhole tool 101, rather than having all of the weight bars located at or near an uphole end of the downhole tool 101.

The downhole tool 101 may be assembled by having an operator make up an orientable weight bar 103 at the uphole end of a set of downhole components 116, such as the downhole components 116*c*, 116*d*, 116*e*. The perforating tools 116*c* may be positioned on the orientable weight bar 103 in an oriented position at an angle in the wellbore 104. Another orientable weight bar 103 may be added on top of the perforating tools 116*c* and secured in position by the lock assembly 328*b*. The process may be repeated until the entire downhole tool 101 is assembled. This configuration may provide the downhole tool 101 with extra weight of about 100 pounds (45.36 kg) of accumulated weight located about the bottom of the downhole tool 101 when in a horizontal position. The orientable weight bars 103 may be used with the orientated perforating tools 116*c* to maintain the perforating tools 116*c* in this position (e.g., along the same radial angle) while traveling through the wellbore 104.

The orientable weight bars 103 may have an offset mass eccentrically weighted about a radial portion of the weight housing 230*a*. This offset mass may be, for example, a radial offset due to a difference in weight in the hemispheric portions of the internal weights 320*a*1,*a*2. The weights 120*a* may be locked in place within the weight housing 230*a* by torquing the lock nut 327*a*. During assembly, the weight bars 103 may be unlocked and released to rotationally move within the weight housing 230*a* by loosening the uphole feedthru 327*d*. The offset mass of the weights 120*a* may be allowed to radially move about the weight housing 230*a* and spin about the internal bearings 329. The internal bearings 329 allow the weight 120*a* to fall to its natural position heavy side down due to gravity. Due to gravitational forces, when unlocked, the offset mass falls to a bottom of the weight housing 230*a*. This bottom defines a radial line or orientation along the downhole tool 101.

Once orientable weight bar 103 is connected to the downhole tool 101, the lock nut 327*a* may be tightened, thereby securing the weights 120*a* in the oriented position. The weights 120*a* may also be secured by extending the key 335 between the weight barrel 333 and the weight housing 230*a* thereby preventing movement therebetween. The key 335 may be used in place of the lock nut 327*a* and permanently installed in the orientable weight bar 103 upon assembly.

Once locked, the orientable weight bar 103 may be delivered for assembly with the rest of the downhole tool 101. This process can repeat for multiple weight bars 103 and/or multiple of the downhole components 116 of the downhole tool 101. The multiple weight bars 103 may be aligned with each other by marking an orientation line along the gravitational bottom of each of the individual weight bars 103 and moving the multiple weight bars 103 into alignment with each other. The weight bars 120 may optionally be secured into position by locking mechanisms, such as set screws, lock rings, collets, spline locks, or other anti-rotation devices.

Once locked into position within the weight housing 230*a* and secured to the downhole tool 101, the weight bars 103 may be capable of urging the downhole tool 101 to remain in this same pre-defined orientation (radial position) as the downhole tool 101 moves through the wellbore 104. This positioning of the offset weight of the weight bar 103 may also be used to time orientation of the perforating tools 116*c* along the wellbore 104. With the orientation maintained, the position of the perforation tool 116*c* during perforation can be more accurately known and/or controlled for consistent and accurate perforation at a desired charge orientation.

The standoff ring 120*b* may facilitate orientation of the downhole tool 101 by spinning about the weight housing 230*a* as the downhole tool passes through the wellbore 104. This may allow the standoff ring 120*b* to frictionally engage the wellbore and spin as necessary, thereby preventing the downhole tool 101 from rotating and allowing the downhole tool 101 to maintain its same orientation.

FIG. 8 is a flow chart depicting methods of orienting a downhole tool. The method 800 involves 880 connecting an orientable weight bar to the downhole tool, the orientable weight bar comprising: a weight housing and an eccentric weight. The method 800 further involves 882—manipulating the downhole tool with the orientable weight bar by: positioning in the eccentric weight in a weighted position within the weight housing by allowing the eccentric weight to gravitationally move within the weight housing; locking the eccentric weight in the weighted position; and the advancing the downhole tool through the wellbore with the eccentric weight in the weighted position. The method 800 may also involve 883—establishing a communication link through the orientable weight bar, and 884—locking the eccentric weight in the weighted position comprises securing the eccentric weight in the weighted position. The locking 884 may be done by: positioning the eccentric weight in a weight barrel within the weight housing and locking the weight barrel to the weight housing; and/or positioning the eccentric weight in a weight barrel within the weight housing and locking an end of the weight barrel to an uphole end of the weight housing.

Part or all of the methods may be performed separately or in combination. One or more portions of the methods may be performed in any order or repeated as desired.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain tools and components (e.g., switches) are provided herein, it will be appreciated that various configurations (e.g., shape, order, orientation, etc.) of tools may be used. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. An orientable weight bar for a downhole tool, comprising:

a weight housing fixedly connectable to the downhole tool;

an eccentric weight positioned in the weight housing, the eccentric weight having an offset mass along a radial portion thereof, the eccentric weight rotationally and gravitationally movable within the weight housing to allow the offset mass to move to a weighted position within the weight housing;

a weight lock operatively connectable between the eccentric weight and the weight housing to secure the offset mass in the weighted position within the weight housing whereby, as the downhole tool advances through a wellbore, the eccentric weight gravitationally urges a portion of the downhole tool toward a bottom of the wellbore;

a weight bar barrel; and end caps;

wherein the end caps are at each end of the weight bar barrel;

wherein the eccentric weight comprises a pair of mated hemispheric weight portions;

wherein the weight bar barrel is positionable between the mated hemispheric weight portions and the weight housing; and wherein the end caps comprise an uphole end cap supported in an uphole connector and a downhole end cap supported in a downhole connector, the uphole connector at an uphole end of the weight housing and the downhole connector at a downhole end of the weight housing.

2. The orientable weight bar of claim 1, further comprising a link assembly comprising an uphole feedthru positioned in the uphole connector, a downhole feedthru positioned in the downhole connector, and a cable connected to the uphole feedthru and the downhole feedthru.

3. The orientable weight bar of claim 1, wherein the weight lock comprises a lock assembly positioned in the uphole connector and connected to the eccentric weight, the lock assembly movable between a locked position allowing movement of the eccentric weight and unlocked position preventing movement of the eccentric weight.

4. The orientable weight bar of claim 3, wherein the lock assembly comprises a lock nut, a spring, a bulkhead, and an insulator.

5. The orientable weight bar of claim 1, further comprising at least one bearing between the eccentric weight and at least one of the uphole connector and the downhole connector.

6. The orientable weight bar of claim 1, wherein each of mated hemispheric weight portions have a different weight.

7. The orientable weight bar of claim 1, wherein the weight lock comprises a key extendable between the weight bar barrel and the weight housing.

8. The orientable weight bar of claim 1, further comprising a standoff ring rotationally positionable about an outer surface of the weight housing.

9. The orientable weight bar of claim 8, wherein the standoff ring comprises a female roller standoff, a male roller standoff, a roller bearing, and a sleeve.

10. A downhole tool, comprising:

at least one downhole component; and an orientable weight bar operatively connectable to the at least one downhole component, the orientable weight bar comprising:

a weight housing fixedly connectable to the downhole tool;

an eccentric weight positioned in the weight housing, the eccentric weight having an offset mass along a radial portion thereof, the eccentric weight rotationally and gravitationally movable within the weight housing to allow the offset mass to move to a weighted position within the weight housing;

a weight lock operatively connectable between the eccentric weight and the weight housing to secure the offset mass in the weighted position within the weight housing whereby, as the downhole tool advances through a wellbore, the eccentric weight gravitationally urges a portion of the downhole tool toward a bottom of the wellbore;

a weight bar barrel; and end caps;

wherein the end caps are at each end of the weight bar barrel;

wherein the eccentric weight comprises a pair of mated hemispheric weight portions;

wherein the weight bar barrel is positionable between the mated hemispheric weight portions and the weight housing; and wherein the end caps comprise an uphole end cap supported in an uphole connector and a downhole end cap supported in a downhole connector, the uphole connector at an uphole end of the weight housing and the downhole connector at a downhole end of the weight housing.

11. The downhole tool of claim 10, wherein the downhole component comprises at least one of a collar locator, a perforating gun, a setting tool, and a plug assembly.

12. The downhole tool of claim 10, further comprising a communication link extending through the orientable weight bar and the at least one downhole component.

13. A method of orienting a downhole tool, comprising:

connecting an orientable weight bar to the downhole tool, the orientable weight bar comprising a weight housing, an eccentric weight, a weight bar barrel, and end caps;

wherein the end caps are at each end of the weight bar barrel;

wherein the eccentric weight comprises a pair of mated hemispheric weight portions;

wherein the weight bar barrel is positionable between the mated hemispheric weight portions and the weight housing; and wherein the end caps comprise an uphole end cap supported in an uphole connector and a downhole end cap supported in a downhole connector, the uphole connector at an uphole end of the weight housing and the downhole connector at a downhole end of the weight housing;

manipulating the downhole tool with the orientable weight bar by:

positioning in the eccentric weight in a weighted position within the weight housing by allowing the eccentric weight to gravitationally move within the weight housing;

locking the eccentric weight in the weighted position; and advancing the downhole tool through a wellbore with the eccentric weight in the weighted position.

14. The method of claim 13, further comprising establishing a communication link through the orientable weight bar.

15. The method of claim 13, wherein the locking the eccentric weight in the weighted position comprises securing the eccentric weight in the weighted position by positioning the eccentric weight in a weight bar barrel within the weight housing and locking the weight bar barrel to the weight housing.

16. The method of claim 13, wherein the locking the eccentric weight in the weighted position comprises securing the eccentric weight in the weighted position by positioning the eccentric weight in a weight bar barrel within the weight housing and locking an end of the weight bar barrel to an uphole end of the weight housing.

17. The method of claim 13, wherein the orientable weight bar further comprises a standoff ring rotationally positioned about an outer surface of the weight housing, the method further comprising preventing rotation of the downhole tool by engaging a wall of the wellbore with the standoff ring as the downhole tool advances through the wellbore.

* * * * *